US010543585B2

(12) United States Patent
Hirse

(10) Patent No.: US 10,543,585 B2
(45) Date of Patent: Jan. 28, 2020

(54) WRENCH IN THE FORM OF AN OPEN-END WRENCH FOR RATCHETING INCREMENTS OF 30°

(71) Applicant: Hirse-Patent-Lizenz-GmbH, Neu-Isenburg (DE)

(72) Inventor: Gernot Hirse, Neu-Isenburg (DE)

(73) Assignee: Hirse-Patent-Lizenz-GmbH, Neu-Isenburg (DE)

( * ) Notice: Subject to any disclaimer, the term of this patent is extended or adjusted under 35 U.S.C. 154(b) by 129 days.

(21) Appl. No.: 15/740,379

(22) PCT Filed: May 25, 2016

(86) PCT No.: PCT/EP2016/061772
§ 371 (c)(1),
(2) Date: Dec. 28, 2017

(87) PCT Pub. No.: WO2016/193086
PCT Pub. Date: Dec. 8, 2016

(65) Prior Publication Data

US 2018/0193984 A1 Jul. 12, 2018

(30) Foreign Application Priority Data

Jun. 3, 2015 (DE) ..... 10 2015 108 856

(51) Int. Cl.
*B25B 13/46* (2006.01)
*B25B 13/32* (2006.01)
*B25B 13/08* (2006.01)

(52) U.S. Cl.
CPC ..... *B25B 13/46* (2013.01); *B25B 13/08* (2013.01); *B25B 13/32* (2013.01)

(58) Field of Classification Search
CPC ..... B25B 13/32
(Continued)

(56) References Cited

U.S. PATENT DOCUMENTS 95,438 A * 10/1869 Davis ..... B25B 13/46 81/90.1
924,816 A * 6/1909 Newell ..... B25B 13/46 30/94

(Continued)

FOREIGN PATENT DOCUMENTS

DE 449510 9/1927
DE 20303016 U1 5/2003

(Continued)

*Primary Examiner* — Hadi Shakeri
(74) *Attorney, Agent, or Firm* — Smartpat PLC

(57) ABSTRACT

An open-end wrench for ratcheting increments of 30° has a short clamping jaw supported on a wrench handle so as to be pivotable about a first pivot point. A long clamping jaw is supported on the wrench handle so as to be pivotable about a second pivot point. The short clamping jaw and the long clamping jaw are each pressed into a clamping position by a spring load and can be pivoted into a receiving position against the spring load. In the clamping position, the short clamping jaw and the long clamping jaw reach around a hexagonal object. To pivot into the receiving position, the short clamping jaw is pressed against a sliding surface of the long clamping jaw by the spring load. In the clamping position, an opening width the clamping jaws is more than 55% of the distance between two opposite lateral edges of the hexagonal object.

13 Claims, 3 Drawing Sheets

(58) Field of Classification Search
USPC ..... 81/91.2, 90.3
See application file for complete search history.

(56) References Cited

U.S. PATENT DOCUMENTS

| | | | | | |
|---|---|---|---|---|---|
| 2,537,838 | A | | 1/1951 | Logan | |
| 2,814,225 | A | * | 11/1957 | Mann | B25B 13/46 81/90.3 |
| 2,823,568 | A | * | 2/1958 | Mann | B25B 13/46 81/90.3 |
| 4,584,913 | A | | 4/1986 | Logan | |
| 4,773,287 | A | | 9/1988 | Clarke | |
| 5,050,464 | A | * | 9/1991 | Hurtig | B25B 13/12 81/90.1 |
| 6,339,978 | B1 | | 1/2002 | Hirse | |

FOREIGN PATENT DOCUMENTS

| | | |
|---|---|---|
| DE | 19747536 | 6/2004 |
| WO | 9305928 | 4/1993 |

* cited by examiner

WRENCH IN THE FORM OF AN OPEN-END WRENCH FOR RATCHETING INCREMENTS OF 30°

TECHNICAL FIELD

The present invention generally relates to a wrench, and more particularly, to a wrench in the form of an open-end wrench for ratcheting increments of 30°.

BACKGROUND

A wrench is a manually operated tool that can be used to tighten or loosen screws or nuts using a rotating action. The wrench is placed or pushed onto a screw head or a nut and has clamping jaws that engage with the screw head or the nut and can transmit a torque exerted with the wrench by the user onto the screw or nut.

A wide range of different wrench designs are known from practice. Wrenches in the form of an open-end wrench are often used for assembling heating and sanitary installations. Screw heads or nuts with a hexagonal profile fit flush into such wrenches and can be turned via a corresponding actuation of the wrench. In order to facilitate simple and reliable handling and actuation of the wrench, it has proved to be advantageous for the wrench to have clamping surfaces on the clamping jaws that are as extensive as possible and that enable a form-fitting engagement with multiple lateral edges of the hexagonal object during a rotational movement.

In order to enable the hexagonal objects to be gripped and pivoted by the wrench even in cramped installation positions, it is expedient for the wrench to have clamping jaws with clamping surfaces that are designed such that the wrench can grip a hexagonal object not only after a rotation through 60°, but also after a rotation of the hexagonal object through 30° in the same direction relative to the hexagonal object and can be used and actuated accordingly for a further rotational movement through 30°.

Several complete rotations of a hexagonal object are usually required in order to fully tighten or loosen the hexagonal object. In the case of individual rotation steps of approximately 30°, the wrench must frequently be removed from the hexagonal object and replaced in order to enable execution of the full tightening process or loosening process of the hexagonal object. In order to facilitate multiple instances of removing and replacing the wrench on the hexagonal object, or to avoid it entirely, various wrenches are known from practice that have a ratchet function for ratcheting increments of 30°. Ratchet wrenches of this kind run free in one direction of rotation and enable renewed gripping of the hexagonal object that has been turned through 30° without the need to loosen and replace the wrench on the hexagonal object. In this case, a first clamping jaw is often mounted pivotably on the wrench handle relative to a second clamping jaw, or on the second clamping jaw. When the ratchet wrench is turned in a tightening direction, both clamping jaws closely abut the hexagonal object and enable a torque to be exerted on the hexagonal object. When the ratchet wrench is turned in a reset direction counter to the tightening direction, the two clamping jaws pivot into a position in which they are spaced apart and enable the ratchet wrench to be turned in a direction of rotation counter to the tightening direction, or in the reset direction relative to the hexagonal object, through 30° or a multiple of 30°, and to then grip the hexagonal object again through another rotational movement of the ratchet wrench in the tightening direction and to turn the hexagonal object in the tightening direction. Such wrenches with a ratchet function are described, for example, in U.S. Pat. No. 4,584,913 or in DE 197 47 536 B4.

In order to place a wrench with a pivotably mounted clamping jaw laterally onto a hexagonal object, it is often necessary to pivot the pivotably mounted clamping jaw wide open and to pivot it into an open receiving position in which the opened clamping jaws have a width that is greater than twice the width of the unopened engagement position where the jaws abut closely. Where the two clamping jaws are intended to abut more than four lateral edges of the hexagonal object in an engagement position in order to ensure that the hexagonal object is gripped such that it is secured against slipping out, an especially widely opened receiving position is required in order to insert the hexagonal object between the two clamping jaws. Widely opened clamping jaws make handling of the wrench more difficult, especially in cramped conditions.

The object of the present invention is therefore to configure a wrench in the form of an open-end wrench for ratcheting increments of 30° such that a hexagonal object can be reliably gripped with the lowest possible space requirements and can be turned with a high level of operating comfort in multiple ratcheting increments of 30° each.

SUMMARY

This object is achieved according to the invention with a wrench with a short clamping jaw which is supported on a wrench handle so as to be pivotable about a first pivot point, and a long clamping jaw which is supported on the wrench handle so as to be pivotable about a second pivot point, wherein the first pivot point is arranged spaced apart from the second pivot point in a longitudinal direction of the handle, wherein the short clamping jaw and the long clamping jaw are each pressed into a clamping position by a spring load and can be pivoted into an open receiving position against the spring load, wherein, in the clamping position, the short clamping jaw and the long clamping jaw reach around a hexagonal object at five lateral edges of the hexagonal object in a first engagement position and in a second engagement position pivoted by 30°. With each of the two pivotably mounted clamping jaws, a very simple yet reliable to handle wrench with a ratchet function can be realized. Since the hexagonal object is gripped at five lateral edges in both of the engagement positions, the wrench can surround the hexagonal object in a form-fitting manner in a way that is secure against removal and, in the case of high mechanical forces, also secure against slipping, so that it can exert large forces and moments on the hexagonal object. The short clamping jaw and the long clamping jaw are pressed into a clamping position by a spring load of a suitably designed spring device, so that a hexagonal object held between the short clamping jaw and the long clamping jaw can be reliably gripped without the exertion of any external force or an additional rotational movement. The short clamping jaw and the long clamping jaw are advantageously designed to be self-locking and/or self-locking due to their pivotable mounting at the first pivot point and the second pivot point.

According to the invention, it is provided that during the pivoting of the clamping jaws into the receiving position, a distance between a first clamping surface of the short clamping jaw and a second clamping surface of the long clamping jaw becomes larger and the hexagonal object can be inserted between the short clamping jaw and the long clamping jaw, wherein, during the pivoting into the receiving position, the short clamping jaw is pressed against a sliding surface of the long clamping jaw by the spring load and performs a pivoting motion in the same direction of rotation. The short clamping jaw is pivoted together with the clamping jaw due to the pressing against the sliding surface of the long clamping jaw and is guided by the long clamping jaw. This enables an operative connection between the short clamping jaw and the long clamping jaw to be realized with a simple design, so that the two clamping jaws only undergo the necessary pivoting movements during the pivoting into the open receiving position and an undesired, potentially uncontrolled pivoting movement of one clamping jaw relative to the other clamping jaw can be avoided. The distance between the two clamping jaws during a pivoting movement is prescribed by the pressing of the short clamping jaw against the sliding surface of the long clamping jaw and can thereby be reduced to a necessary minimum.

It is also provided according to the invention that the long clamping jaw has an actuating device with which the long clamping jaw can be manually pivoted into the receiving position, wherein in the fully opened receiving position, the long clamping jaw projects laterally over the wrench handle in the direction of the width of the wrench handle for a distance of less than double the width of the wrench handle. With the actuating device, the long clamping jaw can be deflected and pivoted into the receiving position independently of a positioning and alignment of the wrench relative to the hexagonal object and in particular without a separate rotational movement being necessary for this. The short clamping jaw follows the long clamping jaw due to the spring load, since the short clamping jaw is pressed against the sliding surface of the long clamping jaw. The wrench can be easily opened using the actuating device, in order to insert the hexagonal object between the clamping jaws of the wrench. In particular, the actuating device makes it possible to easily pivot the two clamping jaws out of an engagement position and detach them from the hexagonal object in order to remove the wrench from the hexagonal object.

Limiting the pivoting movement of the long clamping jaw ensures that the long clamping jaw does not project excessively over the wrench handle in the fully opened receiving position, with the result that the handling of the wrench, and in particular the use of the wrench in cramped spaces, is made significantly easier.

A further aspect of the inventive concept concerns an opening width between ends of the short clamping jaw and of the long clamping jaw facing away from each other, which according to the invention is more than 55% of the distance between two opposite lateral edges of the hexagonal object in the clamping position. In the clamping position, the opening width must be less than the distance between two opposite lateral edges of the hexagonal object, since the hexagonal object is gripped at five lateral edges in each case in the clamping position. In the case of a low opening width, for example less than 50%, the long clamping jaw and the short clamping jaw would each have to be pivoted through a large pivot angle into the open receiving position so that the opening width in the receiving position can be enlarged to a sufficient extent to receive the hexagonal object. However, a large pivoting movement that would be needed here is considered to be of little advantage, since a width of the opened wrench is thereby significantly increased and the handling of the opened wrench is made more difficult, in particular in cramped conditions.

It has proved to be particularly advantageous for the opening width between ends of the short clamping jaw and of the long clamping jaw facing away from each other to be, in the clamping position, more than 70%, preferably more than 80% of the distance between two opposite lateral edges of the hexagonal object. An opening width of this size in the clamping position requires the two clamping jaws to be pivoted only a small distance in order to achieve an opening width of 100% or more in the open receiving position, so that the hexagonal object can be inserted laterally into a wrench mouth formed by the two clamping jaws. For a reliable and form-fitting gripping of the hexagonal object in the clamping position and/or in one of the two engagement positions, a small undercut or bearing surface is sufficient, so that the opening width in the clamping position need only be slightly smaller than 100° of the distance between two opposite lateral edges of the hexagonal object.

According to an especially advantageous embodiment of the inventive concept, it is provided that the first clamping surface of the short clamping jaw and the second clamping surface of the long clamping jaw each have a number of recesses for receiving in each case a corner of the hexagonal object, wherein, in the first engagement position and in the second engagement position, lateral faces of the recesses bear against sections of the lateral edges of the hexagonal object that are adjacent to four corners of the hexagonal object in both directions in each case. For example, the long clamping jaw can have four recesses and the short clamping jaw can have three recesses that are each designed such that a corner of the hexagonal object can be received in the relevant recess and can be surrounded by the recess in a form-fitting manner. The recess may have a triangular shape for this purpose, with an opening angle of 120°. A further recess can be formed between the long clamping jaw and the short clamping jaw through a corresponding configuration of the facing end regions of the clamping jaws in the clamping position. In this manner, the hexagonal object can be gripped at four corners in every engagement position, so that when the wrench that is in the first engagement position or in the second engagement position is turned, torques and forces for turning the hexagonal object can be exerted on four corner regions.

It has proved to be especially advantageous for the long clamping jaw to have, on its end facing away from the short clamping jaw, a gripping tooth that faces the hexagonal object. The gripping tooth restricts the opening width between the ends of the clamping jaws facing away from each other. With the gripping tooth, the corner of the hexagonal object that is assigned to the gripping tooth is sufficiently reliably received and held in the relevant engagement position.

In order to reliably prescribe the alignment of the two clamping jaws relative to each other in the clamping position, the present invention provides that the long clamping jaw has a stop face against which the short clamping jaw bears in the clamping position. Unintentional tilting of the two clamping jaws can therefore be avoided, even in the case of heavy mechanical loading of the wrench.

The short clamping jaw should expediently bear against the long clamping jaw in a spring-loaded manner and, when the long clamping jaw is pivoted, should bear against the sliding surface that is formed on the long clamping jaw and also be pivoted. For this purpose, it is advantageous according to one embodiment of the inventive concept for a spring device to be in operative connection with the short clamping jaw and with the long clamping jaw. The spring device can act on both clamping jaws at the same time. The short clamping jaw can be acted on via the spring device through a pivoting movement of the long clamping jaw, in order for example to generate a spring force that acts in the same direction and is exerted on the short clamping jaw in accordance with the pivoting movement of the long clamping jaw. The spring device can be manufactured and installed cost-effectively and, depending on the design of the spring device, enables the two clamping jaws to be acted on either independently of each other or in dependence on each other.

An especially cost-efficient and also effective configuration of the spring device that is less susceptible to faults provides that the spring device has a leg spring fixed on the wrench handle, the first spring leg of which leg spring is in operative connection with the short clamping jaw and the second spring leg of which is in operative connection with the long clamping jaw.

With regard to simple and convenient handling of the wrench even in cramped conditions, it is provided according to the invention that, in the receiving position, a distance between opposite outer surface sections of the short clamping jaw and the long clamping jaw is less than 2.9 times the width of the wrench handle, preferably less than 2.3 times the width of the wrench handle, and particularly preferably less than double the width of the wrench handle. The lower the distance between the opposite outer surface sections of the clamping jaws in the receiving position and thus a width between the opened wrench mouth of the wrench in the receiving position, the more easily the wrench can be opened and pushed onto a hexagonal object in cramped conditions.

In the case of heating and sanitary installations in particular, as well as in mechanical engineering, comparatively large hexagonal objects can be installed on inaccessible line sections or connections, the actuation of which also requires a large torque to be exerted. The dimensions of the wrench and in particular of the clamping jaws pivotably mounted on the wrench handle may not be made arbitrarily small, since otherwise the wrench would not have the sufficient mechanical strength and the intended use of the wrench would frequently lead to damage to the wrench and at least to impairment of the intended use of the wrench and actuation of the hexagonal object in question. With the measures described above, it is possible to ensure that the opened clamping jaws do not excessively impair the handling of the wrench.

The handling can additionally be facilitated in that, on a side facing away from the long clamping jaw, the short clamping jaw does not project laterally over the wrench handle. This allows protruding edges and corners of the wrench to be avoided or at least for their impact to be reduced.

In order to further facilitate ease of handling, it is also provided that the wrench has an actuating device with which the long clamping jaw can be pivoted from the clamping position into the receiving position. The wrench can be opened with the actuating device in order to receive a hexagonal object or to release a hexagonal object that has been turned by the wrench. The actuating device can be arranged and configured in the region of the wrench handle such that the actuating device can be actuated by a user without the need to grip and actuate the wrench with both hands. Instead, the actuating device can for example be actuated by a finger movement or a hand grip with the hand that the user is using to grip and actuate the wrench.

It is preferably provided that the actuating device is formed by a shaping of the long clamping jaw that forms an actuating lever that extends past the second pivot point on an end of the long clamping jaw that opposes the second clamping surface, which actuating lever projects laterally over the wrench handle in the clamping position. Here, the actuating lever can optionally project laterally over the wrench handle on one of the two sides of the wrench handle. The actuating lever can be actuated either with the palm of a user's hand that is gripping the wrench handle or with the fingers that are wrapped around the wrench handle. The configuration of the actuating device can also be adapted to the forces and torques that are expected to occur during normal actuation of the wrench.

BRIEF DESCRIPTION OF THE DRAWINGS

An exemplary embodiment of the inventive concept that is shown in the drawings is explained below in more detail. In the drawings.

DETAILED DESCRIPTION

Figure 1:
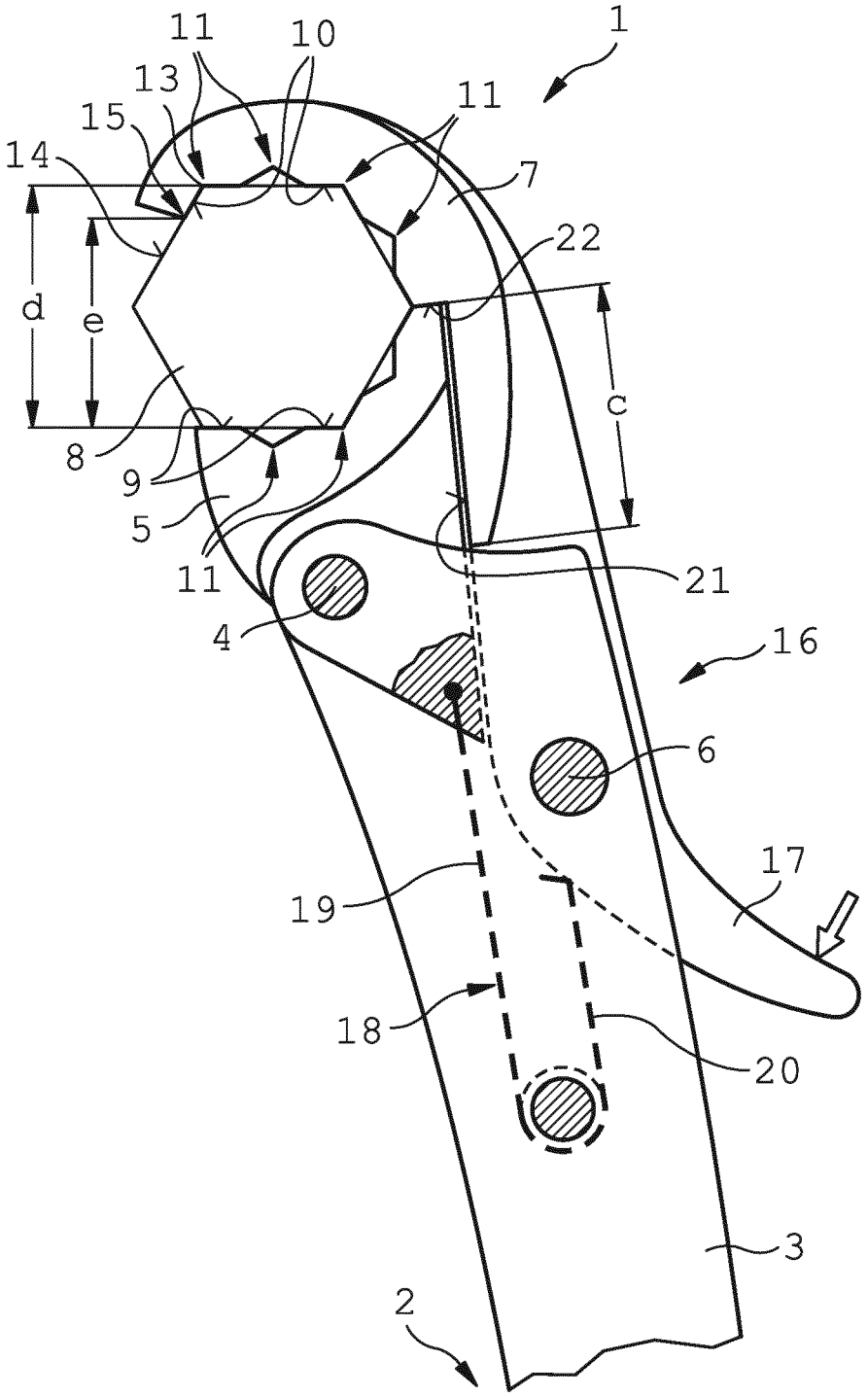
FIG. 1 shows a schematic representation of a wrench according to the invention, wherein a wrench handle of the wrench is not shown in its full length and wherein a short clamping jaw and a long clamping jaw of the wrench are gripping a hexagonal object.

A wrench 1 depicted by way of example in FIGS. 1 to 5 and in a partially cut representation respectively has an elongated handle grip 3 that is provided with a handle part 2 not shown in more detail. A short clamping jaw 5 is mounted on the wrench handle 3 so as to be pivotable about a first pivot point 4 and a long clamping jaw 7 is mounted on the wrench handle 3 so as to be pivotable about a second pivot point 6. The two pivot points 4 and 6 are arranged spaced apart from each other both in a longitudinal direction of the handle and in a transverse direction aligned transversely to the longitudinal direction of the handle. In this case, the first pivot point 4 of the short clamping jaw 5 is arranged toward the top left and the second pivot point 6 of the long clamping jaw 7 is arranged toward the bottom in the direction of the handle part 2 and toward the right in FIG. 1.

The two clamping jaws 5 and 7 grip a hexagonal object 8 that can be for example a nut or a screw. The short clamping jaw 5 has a first clamping surface 9 and the long clamping jaw 7 has a second clamping surface 10 in the profile of which three or four successively arranged recesses 11 are formed respectively. Each recess 11 has a base area of an isosceles triangle with an opening angle of 120° that faces the hexagonal object 8, wherein in each case two lateral faces 12 aligned at an angle of 120° to each other delimit a recess 11 and form a section of the relevant clamping surface 9 or 10.

Figure 3:
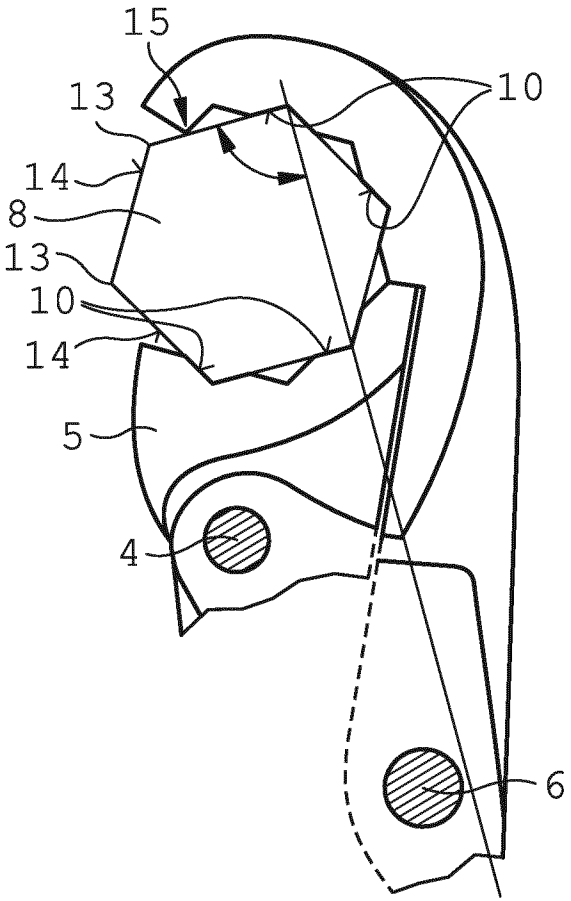
FIG. 3 shows a view of the wrench according to FIG. 2, wherein the two clamping jaws are gripping the hexagonal object in a clamping position, wherein the hexagonal object is shown in a different engagement position to the one depicted in FIG. 1.
Figure 2:
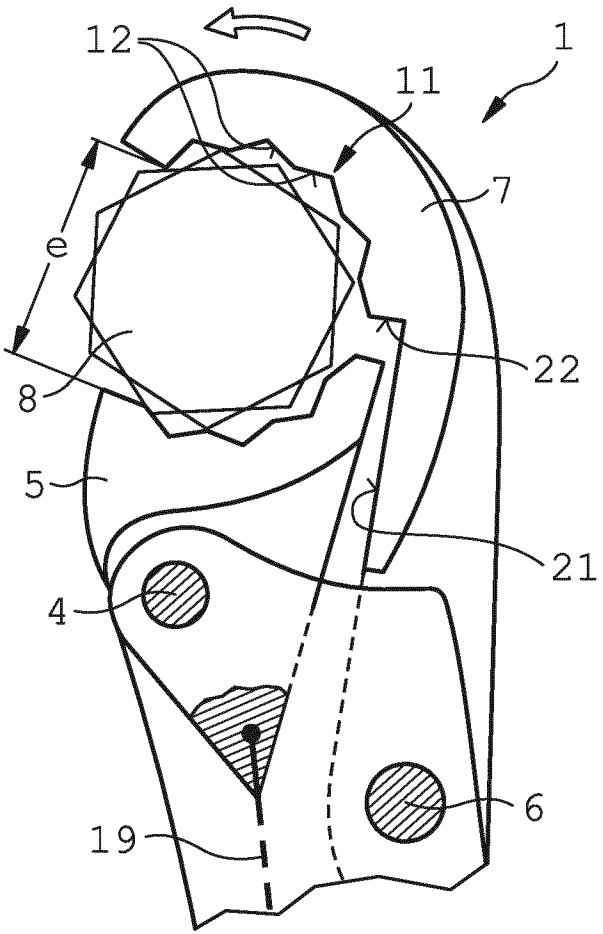
FIG. 2 shows a partial view of the wrench depicted in FIG. 1 that is limited to the two clamping jaws, wherein the two clamping jaws are partially opened and the hexagonal object has been slightly released for the purpose of a ratcheting movement.

In a first engagement position of the hexagonal object 8 between the clamping jaws 5 and 7, which position is shown in FIG. 1, and in a second engagement position of the hexagonal object 8, which position is pivoted through 30° in relation to the first engagement position and is shown in FIG. 3, in each case four corners 13 of the hexagonal object 8 are received in an allocated recess 11 on the clamping surfaces 9 and 10 of the clamping jaws 5 and 7. For each corner 13, the lateral faces 12 of the recesses 11 closely abut sections of lateral edges 14 of the hexagonal object 8 that are adjacent to a corner 13 in both directions and create a form-fitting receiving point for the hexagonal object 8. The first engagement position and the second engagement position, which are shown by way of example in FIGS. 1 and 3, each correspond to a clamping position of the clamping jaws 5 and 7 of the wrench 1.

A gripping tooth 15 that faces the hexagonal object 8 is formed on an end of the long clamping jaw 7 that faces away from the short clamping jaw 5. In the first engagement position, the gripping tooth 15 creates a further form-fitting engagement with the hexagonal object 8. Since the gripping tooth 15 has a large distance from a center axis and from the pivot points 4 and 6 of the pivotably mounted clamping jaws 5 and 7, this distance being measured in a direction transverse to the longitudinal direction of the handle, torques and forces can be exerted on and transmitted to the hexagonal object 8 especially effectively with this gripping tooth 15. Furthermore, the gripping tooth 15 facilitates a self-locking clamping action of the clamping jaws 5 and 7 that are pivoted into the clamping position.

An opening width between ends of the short clamping jaw 5 and of the long clamping jaw 7 facing away from each other, marked with "e" in FIG. 1, is prescribed and delimited by the gripping tooth 15. Consequently, this opening width "e" is smaller than the distance marked as "d" in FIG. 1 between two opposite lateral edges 14 of the hexagonal object 8. In the exemplary embodiment shown by way of example in the figures, the opening width "e" is approximately 90% of the distance "d" between the opposite lateral edges 14, wherein this distance represents a width of the hexagonal object 8.

With a suitable configuration and shaping of the gripping tooth 15, it is possible to ensure that the gripping tooth 15 need project only slightly in the direction of the hexagonal object 8 and, therefore, the opening width "e" need only be specified slightly smaller than the distance "d" or the width of the hexagonal object 8, while it is still possible for large torques to be reliably transmitted to the hexagonal object 8 that is held at four corners 13 in a form-fitting manner and for the hexagonal object 8 to be retained between the clamping jaws 5 and 7 in such a manner that it is secured against slipping out.

Figure 4:
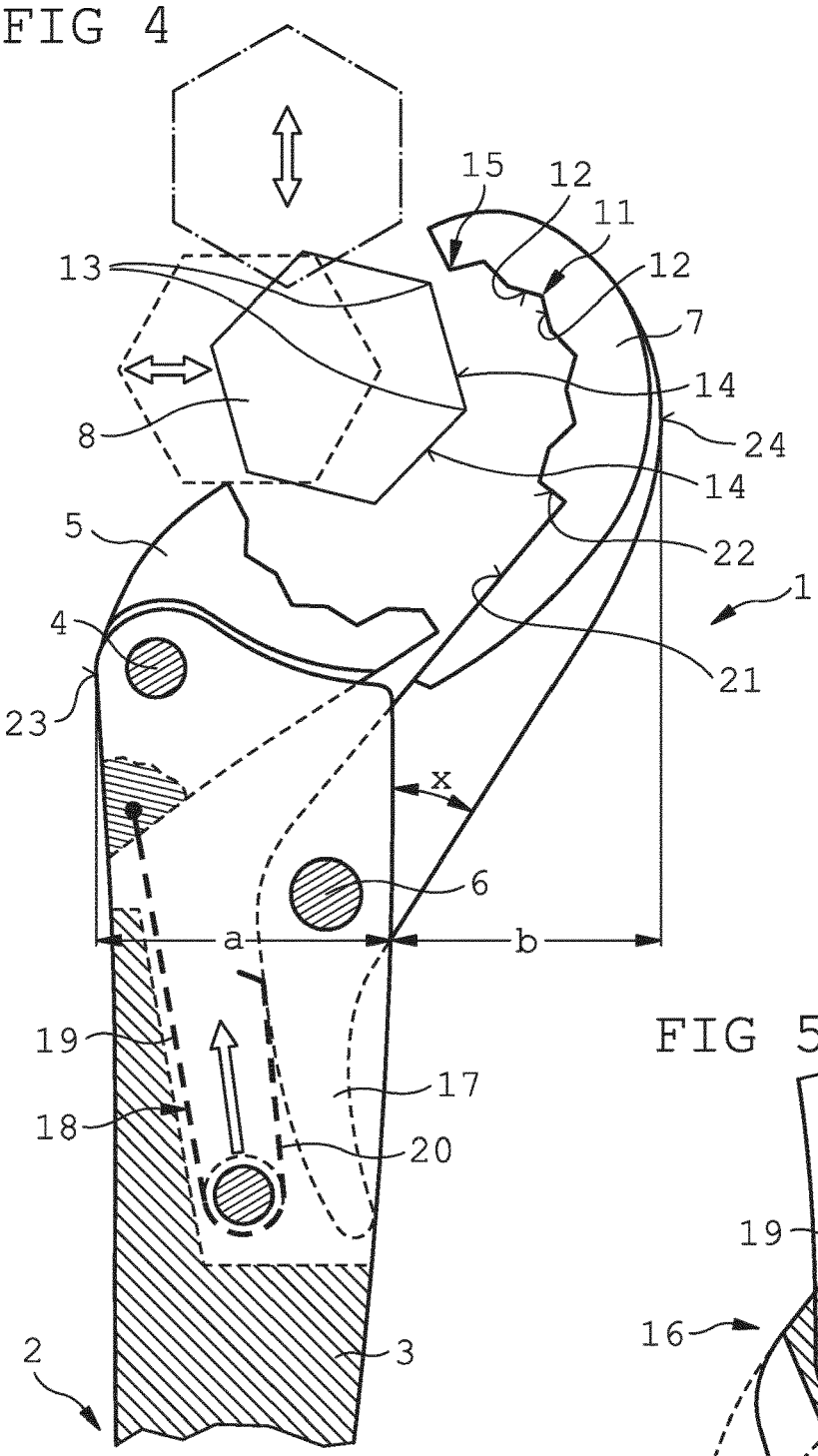
FIG. 4 shows the wrench depicted in FIGS. 1-3, wherein the two pivoting jaws are pivoted into a maximum open receiving position.

In order to insert the hexagonal object between the two clamping jaws 5 and 7 or to loosen and disconnect the wrench 1 from a hexagonal object 8 held in a form-fitting manner between the clamping jaws 5 and 7, it is therefore necessary for the two clamping jaws 5 and 7 to be pivoted into an open receiving position, which is shown in FIG. 4.

For this purpose, the wrench 1 has an actuating device 16 with an actuating lever 17 that projects laterally over the wrench handle 3. The actuating device 16 is formed on the long clamping jaw 7 or is in operative connection with the latter, so that when the actuating lever 17 is actuated by a user of the wrench 1, the long clamping jaw 7 can be manually pivoted into an open receiving position.

A leg spring 18 is also pivotably mounted on the wrench handle 3 such that a first spring leg 19 laterally abuts the short clamping jaw 5 and a second spring leg 20 laterally abuts the long clamping jaw 7. The leg spring 18 establishes an operative connection between the two clamping jaws 5 and 7 and presses both clamping jaws 5 and 7 into their clamping position. In the case of manual deflection of the long clamping jaw 7 into the open receiving position using the actuating device 16, the short clamping jaw 5 is likewise pivoted by the leg spring 18.

An end of the short clamping jaw 5 facing the long clamping jaw 7 is pressed against a sliding surface 21 formed on the long clamping jaw 7 by the spring force of the leg spring 18 and slides along the sliding surface 21 during a pivoting movement, by means of which a guide is formed for the short clamping jaw 5. The long clamping jaw 7 has, at one end of the sliding surface 21, a stop face 22, against which the short clamping jaw 5 bears in the clamping position. The position and arrangement of the two clamping jaws 5 and 7 relative to one another in the clamping position are prescribed by the stop face 22 and undesired tilting of the clamping jaws 5 and 7 is prevented, even in the case of large mechanical loads and/or in the case of large torques being exerted on the hexagonal object 8.

In the open receiving position that is shown in FIG. 4, the two clamping jaws 5 and 7 must have a sufficient spacing between them so that the opening width thereby prescribed between the end regions of the clamping jaws 5 and 7 is larger than the distance between two opposite lateral edges 14 or larger than the width of the hexagonal object 8. Upon pivoting of the clamping jaws 5 and 7, a distance between opposite outer surface sections 23 and 24 of the clamping jaws 5 and 7, which distance is measured transverse to the longitudinal direction of the handle, increases. In addition, at least the long clamping jaw 7 necessarily projects laterally over the wrench handle 3 of the wrench 1. The lateral protrusion of the long clamping jaw 7 is identified with "b" in FIG. 4. In conjunction with a width of the wrench handle 3 that is identified as "a" in this section, the distance between the outer surface sections 23 and 24 results as the sum of "a" and "b". In the exemplary embodiment shown by way of example in FIG. 4, this distance is slightly less than double the width "a" of the wrench handle 3.

Figure 5:
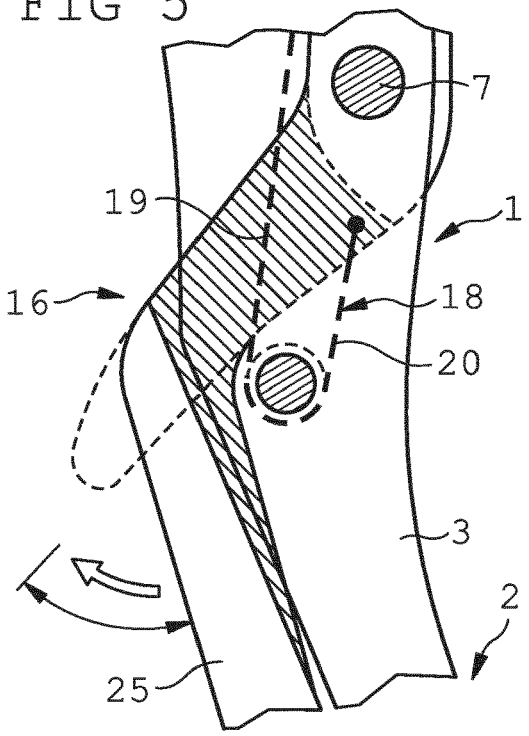
FIG. 5 shows a partial view of a wrench with an alternatively configured actuating device.

FIG. 5 shows merely by way of example an alternative configuration of the actuating device 16 with an actuating lever 25 that projects on an opposite side of the wrench handle 3 and can be actuated from this side. While the actuating lever 17 shown in FIGS. 1 to 4 can be actuated by the palm of a user's hand or by being gripped by the user's index finger, the actuating lever 25 arranged on the opposite handle side enables convenient operation with the fingers during normal handling of the wrench 1 without the user having to grip around it.

The features according to the invention of the wrench 1 enable, on the one hand, reliable holding of the hexagonal object 8 between the clamping jaws 5 and 7 such that it is secured against slipping out, as well as a ratcheting function of the wrench, and on the other hand, the achievement of a wrench mouth width, more specifically the distance between the outer surface sections 23 and 24 of the clamping jaws 5 and 7 in the fully opened receiving position, that is small and that does not negatively affect the handling and actuation of the wrench 1.

The invention claimed is:

1. A wrench (1) in the form of an open-end wrench for ratcheting increments of 30° with a short clamping jaw (5), which is supported on a wrench handle (3) so as to be pivotable about a first pivot point (4) and a long clamping jaw (7) which is supported on the wrench handle (3) so as to be pivotable about a second pivot point (6), wherein the first pivot point (4) is arranged spaced apart from the second pivot point (6) in a longitudinal direction of the handle, wherein the short clamping jaw (5) and the long clamping jaw (7) are each pressed into a clamping position by a spring load and can be pivoted into an open receiving position against the spring load, wherein the spring load acts on the long clamping jaw (7) below the second pivot point in all possible pivot positions of the long clamping jaw (7), wherein in the clamping position, the short clamping jaw (5) and the long clamping jaw (7) reach around a hexagonal object (8) respectively at five lateral edges (14) of the hexagonal object (8) in a first engagement position and in a second engagement position pivoted by 30°, wherein during the pivoting into the receiving position, a distance between a first clamping surface (9) of the short clamping jaw (5) and a second clamping surface (10) of the long clamping jaw (7) becomes larger and the hexagonal object (8) can be inserted between the short clamping jaw (5) and the long clamping jaw (7), wherein during the pivoting into the receiving position, the short clamping jaw (5) is pressed against a sliding surface (21) of the long clamping jaw (7) by the spring load and performs a pivoting motion in the same direction of rotation, wherein the long clamping jaw (7) has an actuating device (16) extending longitudinally below the second pivot point with which the long clamping jaw (7) can be manually pivoted into the receiving position, wherein in the fully opened receiving position, the long clamping jaw (7) projects laterally over the wrench handle (3) in the direction of the width of the wrench handle (3) for a distance of less than double the width of the wrench handle (3) while being pushed by the spring load towards the clamping position, and wherein in the clamping position, an opening width between ends of the short clamping jaw (5) and of the long clamping jaw (7) facing away from each other is more than 55% of the distance between two opposite lateral edges (14) of the hexagonal object (8).

2. The wrench (1) as in claim 1, characterized in that in the clamping position, an opening width between ends of the short clamping jaw (5) and of the long clamping jaw (7) facing away from each other is more than 70% of the distance between two opposite lateral edges (14) of the hexagonal object (8).

3. The wrench (1) as in claim 1, characterized in that the first clamping surface (9) of the short clamping jaw (5) and the second clamping surface (10) of the long clamping jaw (7) each have a number of recesses (11) for receiving in each case a corner (13) of the hexagonal object (8), wherein in the first engagement position and in the second engagement position, in each case lateral faces (12) of the recesses (11) bear against sections of the lateral edges (14) of the hexagonal object (8) that are adjacent to four corners (13) of the hexagonal object (8) in both directions.

4. The wrench (1) as in claim 1, characterized in that on its end facing away from the short clamping jaw (5), the long clamping jaw (7) has a gripping tooth (15) that faces the hexagonal object (8).

5. The wrench (1) as in claim 1, characterized in that the long clamping jaw (7) has a stop face (22) against which the short clamping jaw (5) bears in the clamping position.

6. The wrench (1) as in claim 1, characterized in that a spring device is in operative connection with the short clamping jaw (5) and with the long clamping jaw (7).

7. The wrench (1) as in claim 6, characterized in that the spring device has a leg spring (18) fixed on the wrench handle (3), the first spring leg (19) of which leg spring is in operative connection with the short clamping jaw (5) and the second spring leg (20) of which is in operative connection with the long clamping jaw (7).

8. The wrench (1) as in claim 1, characterized in that in the receiving position, a distance between opposite outer surface sections (23, 24) of the short clamping jaw (5) and the long clamping jaw (7) is less than 2.9 times the width of the wrench handle (3).

9. The wrench (1) as in claim 1, characterized in that on a side facing away from the long clamping jaw (7), the short clamping jaw (5) when pivoted towards the long clamping jaw does not project laterally over the wrench handle (3).

10. The wrench (1) as in claim 1, characterized in that the actuating device (16) is formed by a shaping of the long clamping jaw (7) that forms an actuating lever (17, 25) that extends past the second pivot point (6) on an end of the long clamping jaw (7) that opposes the second clamping surface (10), which actuating lever projects laterally over the wrench handle (3) in the clamping position.

11. The wrench (1) as in claim 1, characterized in that in the clamping position, an opening width between ends of the short clamping jaw (5) and of the long clamping jaw (7) facing away from each other is more than 80% of the distance between two opposite lateral edges (14) of the hexagonal object (8).

12. The wrench (1) as in claim 1, characterized in that in the receiving position, a distance between opposite outer surface sections (23, 24) of the short clamping jaw (5) and the long clamping jaw (7) is less than 2.3 times the width of the wrench handle (3).

13. The wrench (1) as in claim 1, characterized in that in the receiving position, a distance between opposite outer surface sections (23, 24) of the short clamping jaw (5) and the long clamping jaw (7) is less than double the width of the wrench handle (3).

* * * * *